US011796278B1

(12) United States Patent
Miller

(10) Patent No.: US 11,796,278 B1
(45) Date of Patent: Oct. 24, 2023

(54) BOW PRESS ADAPTER ASSEMBLY

(71) Applicant: Lane Miller, Dillon, MT (US)

(72) Inventor: Lane Miller, Dillon, MT (US)

(73) Assignee: Lane Miller, Dillon, MT (US)

( * ) Notice: Subject to any disclaimer, the term of this patent is extended or adjusted under 35 U.S.C. 154(b) by 0 days.

(21) Appl. No.: 17/849,338

(22) Filed: Jun. 24, 2022

(51) Int. Cl.
*F41B 5/00* (2006.01)
*F41B 5/14* (2006.01)

(52) U.S. Cl.
CPC ..... *F41B 5/1449* (2013.01)

(58) Field of Classification Search
CPC ..... F41B 5/1449
See application file for complete search history.

(56) References Cited

U.S. PATENT DOCUMENTS

| | | | | |
|---|---|---|---|---|
| 7,255,099 | B2 * | 8/2007 | Henry | F41B 5/1449 124/1 |
| 9,719,750 | B2 * | 8/2017 | Gouramanis | F41B 5/1449 |
| 9,759,511 | B2 * | 9/2017 | McKinney | F41B 5/1449 |
| 10,921,084 | B2 * | 2/2021 | McPherson | F41B 5/1403 |

* cited by examiner

*Primary Examiner* — John A Ricci
(74) *Attorney, Agent, or Firm* — Berkeley Law & Technology Group, LLP

(57) ABSTRACT

Briefly, an adapter assembly, such as for use with a bow press that may be utilized to retain a bow, such as a compound bow, may include (among other things) an insert at a first end portion of the bow press for inclusion within an opening of the bow press. The adapter assembly may additionally include an arm that abuts the insert, and may further include an axle and bushing to accommodate a first bracket, the first bracket to exert a compressive force on at least one limb of a bow while the bow is placed between the first bracket and a second bracket at a second end portion opposite the first end portion. The arm may extend in a direction toward the second end portion.

20 Claims, 3 Drawing Sheets

BOW PRESS ADAPTER ASSEMBLY

BACKGROUND

1. Field

The present disclosure relates generally to tools utilized in conjunction with certain types of outdoor equipment such as, for example, compound bows, crossbows, and/or related equipment.

2. Information

When repairing and/or adjusting certain types of sporting equipment used in outdoor sports, such as equipment used for bow hunting, archery, or similar sports, a bow press may be utilized to retain, for example, a bow so that a technician or craftsman may manipulate components of the bow. Such manipulations may be performed, for example, to increase an archer's accuracy when using the bow, to replace broken and/or damaged components of the bow, and/or to make other adjustments. A typical bow press may include brackets at opposing ends of the bow press as well as a length-adjusting component, which may operate to modify a linear dimension between the brackets, which may operate to compress the bow thus removing tension from one or more of the strings of the bow. However, despite such length-adjusting components, it may be problematic to situate certain types of compound bows and crossbows within the brackets of a bow press. Thus, developing tools and other equipment to accommodate certain differently-sized compound bows and crossbows, for example, continues to be an active area of investigation.

SUMMARY

One general aspect includes an adapter assembly for use with a bow press, the adapter assembly including an insert disposed at a first end portion of the bow press for inclusion within an opening of the bow press. The adapter assembly also includes an arm that abuts the insert. The adapter assembly additionally includes an axle and bushing for a first bracket, the first bracket to exert a compressive force on at least one limb of a bow while the bow is placed between the first bracket and a second bracket at a second end portion opposite the first end portion, the arm extending in a direction toward the second end portion.

In particular embodiments, the insert of the adapter assembly may include an angled metallic material that is brought into contact with one or more internal surfaces of the opening of the bow press. In particular embodiments, the insert further includes a brace for inclusion with the insert into the opening of the bow press, the brace to be brought into contact with one or more additional internal surfaces (e.g., interior walls) of the opening of the bow press. In particular embodiments, the brace includes a slot to accommodate a fastener and the fastener is to secure the axle and bushing the first bracket. In particular embodiments, the arm abuts the insert at an angle of between approximately 60° and approximately 120°. In particular embodiments, the arm abuts the insert at an angle of approximately 90.0. In particular embodiments, the includes an adjustable length, the adjustable length being between approximately 12.7 cm (approximately 5.0 inches) and approximately 38.1 cm (approximately 15.0 inches). In particular embodiments, the arm adapter assembly includes a material having a tensile strength of between approximately 20 kg and approximately 150 kg.

Another general aspect includes a bow press to exert a compressive force on at least one limb of a bow, the bow press including a bow press length adjuster. The bow press additionally including a first axle and a first bushing and a second axle and a second bushing, the first axle and the first bushing to accept a first bracket and the second axle and the second bushing to accept a second bracket, the first bracket and the second bracket cooperating to retain the bow responsive to adjustment of the bow press length adjuster. The bow press also includes an adapter assembly, the adapter assembly having an insert included within an opening of the bow press proximate the second mount, the adapter assembly having at least one additional axle and one additional bushing to accept at least one additional bracket, the adapter assembly having an arm that operates to reduce a linear dimension between the at least one additional bracket and the first bracket relative to a linear dimension between the first bracket and the second bracket.

In particular embodiments, the insert of the adapter assembly includes an angled metallic material that is brought into contact with one or more internal surfaces of the opening of the bow press. In particular embodiments, the insert of the adapter assembly further includes a brace for inclusion with the insert into the opening of the bow press, the brace to be brought into contact with one or more additional internal surfaces of the opening of the bow press. In particular embodiments, the brace of the insert includes a slot to accommodate a reverse side of a fastener, the fastener to secure the second axle in the second bushing for the second bracket. In particular embodiments, the arm of the adapter assembly abuts the insert at an angle of between approximately 60° and approximately 120°. In particular embodiments, the arm of the adapter assembly abuts the insert at an angle of approximately 90.0°. In particular embodiments, the arm of the adapter assembly includes an adjustable length, the adjustable length being between approximately 12.7 cm (approximately 5.0 inches) and approximately 38.1 cm (approximately 15.0 inches). In particular embodiments, the arm of the adapter assembly includes a material having a tensile strength of between approximately 20 kg and approximately 150 kg. in particular embodiments, the arm of the adapter assembly and the body of the bow press operate in substantially the same plane.

Another general aspect includes an adapter assembly for use with a bow press, the adapter assembly including an insert for inclusion within a tubular opening of the bow press. The adapter assembly also including an arm that abuts the insert. The adapter assembly also includes a mounting surface that abuts the arm, the mounting surface to accommodate a first axle and first bushing for a first bracket, the first bracket, the mounting surface, the arm, and the insert being to exert a compressive force on at least one limb of a bow responsive to positioning of the bow between the first bracket of the bow press and a second bracket of the bow press.

In particular embodiments, the adapter assembly includes a slotted bracket coupled to the insert for inclusion within the tubular opening of the bow press. In particular embodiments, the adapter assembly includes a material having a tensile strength of between approximately 20 kg and approximately 150 kg.

DESCRIPTION OF THE DRAWINGS

Claimed subject matter is particularly pointed out and distinctly claimed in the concluding portion of the specification. However, both as to organization and/or method of operation, together with objects, features, and/or advantages thereof, it may best be understood by reference to the following detailed description if read with the accompanying drawings in which:

Figure 1:
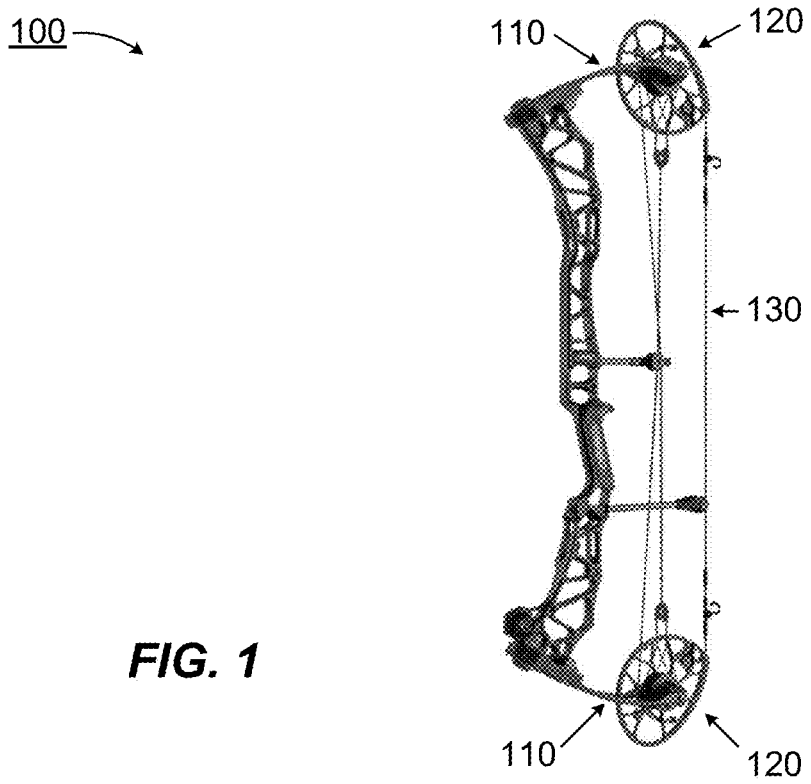
FIG. 1 shows a compound bow suitable for fitting within brackets of a bow press according to various embodiments.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration. For example, dimensions of some aspects may be exaggerated relative to others, one or more aspects, properties, etc. may be omitted, such as for ease of discussion, or the like. Further, it is to be understood that other embodiments may be utilized. Furthermore, structural and/or other changes may be made without departing from claimed subject matter. References throughout this specification to "claimed subject matter" refer to subject matter intended to be covered by one or more claims, or any portion thereof, and are not necessarily intended to refer to a complete claim set, to a particular combination of claim sets (e.g., method claims, apparatus claims, etc.), or to a particular claim. It should also be noted that directions and/or references, for example, such as up, down, top, bottom, and so on, may be used to facilitate discussion of drawings and are not intended to restrict application of claimed subject matter. Therefore, the following detailed description is not to be taken to limit claimed subject matter and/or equivalents.

DETAILED DESCRIPTION

References throughout this specification to one implementation, an implementation, one embodiment, an embodiment, and/or the like means that a particular feature, structure, characteristic, and/or the like described in relation to a particular implementation and/or embodiment is included in at least one implementation and/or embodiment of claimed subject matter. Thus, appearances of such phrases, for example, in various places throughout this specification are not necessarily intended to refer to the same implementation and/or embodiment or to any one particular implementation and/or embodiment. Furthermore, it is to be understood that particular features, structures, characteristics, or the like described are capable of being combined in various ways in one or more implementations and/or embodiments and, therefore, are within intended claim scope. In general, of course, for the specification of a patent application, these and other issues have a potential to vary in a particular context of usage. In other words, throughout the disclosure, particular context of description and/or usage provides helpful guidance regarding reasonable inferences to be drawn; however, likewise, "in this context" in general without further qualification refers at least to the context of the present patent application.

Some example apparatuses and/or articles of manufacture are shown and described herein, which may be used in whole or in part, to facilitate and/or support one or more operations and/or techniques for adapting or adjusting a bow press to accommodate differently-sized (e.g., smaller-sized) standard bows, smaller-sized compound bows, and particular sizes of crossbows. Via adjustment of a bow press, a craftsman or a technician may conveniently and safely perform modifications and/or repair damaged components of, for example, a compound bow. Such modifications and/or repairs to a compound bow, for example, utilizing apparatuses and/or articles of manufacture shown and described herein, may be performed with greater ease and precision than modifications and/or repairs performed utilizing alternative equipment. Such alternative equipment may comprise, for example, cables having discrete stops or notches that are utilized to pull opposing ends or "limbs" of a compound bow, for example, together so as to remove tension created by strings of the compound bow. In response to such pulling together of the limbs of a compound bow, the cable stop or notch may be fixed or locked into place, thereby allowing a technician or a craftsman to perform maintenance, for example, on the bow. However, such alternative equipment may be prone to undesirable cable slippage, in which the notched cable is no longer fixed or locked into place. This may result in a rapid and uncontrollable release of tension on the opposing ends or limbs of the compound bow. Release of such tension may bring about damage to a compound bow undergoing compression and/or may injure a repairperson or other skilled worker performing operations on the compound bow.

To provide an approach toward mounting and/or securely retaining, for example, a compound bow, within opposing brackets of a bow press, an adapter assembly may be utilized in cooperation with the bow press. The adapter assembly may include at least one insertable section of angle iron or other type of angled metallic material, for example, which may fit within a hollow opening of the bow press, such as a hollow opening near a first end portion of the press. The insertable section of angle iron (or other type of angled metallic material) may be coupled to a brace which, as described hereinbelow, may operate to permit the insertable section of angle iron to fit securely within the hollow opening of the bow press. In particular embodiments, the adapter assembly may include an arm comprising hollow metallic tubing. The hollow metallic tubing of the arm may abut the insertable section of angle iron, such as at an angle that approaches approximately 90°. In particular embodiments, the arm may extend in a direction from the first end portion of the press in a direction toward an opposite end of the press. A mounting surface, which may also comprise hollow metallic tubing, may abut the arm of the adapter assembly. The mounting surface may provide a surface to which a stubbed axle and a bushing may be affixed. One or more brackets may then be slid over the stubbed axle, which may operate to securely retain the limbs of a compound bow, crossbow, or other type of bow, for example. In particular embodiments, as shown and described hereinbelow, the insertable section of angle iron, the hollow metallic tubing of the arm, and the mounting surface of the adapter assembly may all be oriented in the same plane. In particular embodiments, the arm may be extendable in length within a certain range, so as to provide additional flexibility in accommodating various compound bow sizes and/or crossbow sizes.

Thus, in accordance with particular embodiments, a technician attempting to perform adjustments or other types of modifications to a crossbow or a smaller-sized compound bow may quickly and easily connect an adapter to a standard-sized bow press to accommodate the crossbow or smaller-sized compound bow. The technician may then position the smaller-sized compound bow within brackets of the adapter and, utilizing a length adjuster, may compress the bow between the brackets of the bow press. Such positioning of the smaller-sized compound bow, for example, within existing brackets of the bow press and brackets of the adapter may allow the technician to safely perform modifications, adjustments, and/or repairs to the compound bow.

In this context, a "bow" refers to an apparatus used in archery and/or hunting to propel a projectile (e.g., an arrow) via release of tension applied to the limbs of the bow. Tension may be applied to the limbs of the bow via displacement of one or more strings of the bow, which are coupled or connected to the limbs of the bow, thereby imparting potential energy to the limbs of the bow. Via release of the bow string, the limbs of the bow may be permitted to return to a neutral position, thereby propelling the projectile (e.g., an arrow) in a desired direction. Also in this context a "bow press" refers to a stationary (or at least substantially stationary) apparatus, which operates to secure the bow with an brackets attached at opposite ends of the bow press. Via adjusting the width of the bow press, the limbs of the bow may be pressed or pushed toward the center of the bow. Such compression of the limbs of the bow operates to release tension on the one or more bowstrings. Accordingly, a technician, for example, may adjust one or more cams or pulleys of, for example, a compound bow, remove/replace one or more strings of a compound bow, or perform other repairs and/or modifications.

FIG. 1 shows a compound bow suitable for fitting within brackets of a bow press that accords with an embodiment 100. In FIG. 1, compound bow 100 includes limbs 110, which are situated at first and second ends of the compound bow. Limbs 110 apply increasing tension to bowstring 130 responsive to an archer, for example, drawing the bowstring toward the archer. Upon release of the projectile, such as an arrow, the projectile may fly in the direction of a desired object, which may include a target, a game animal, or the like. In the embodiment of FIG. 1, cam 120 operates to compress limbs 110 in a manner that may not be linearly proportional to displacement of bowstring 130.

Figure 2:
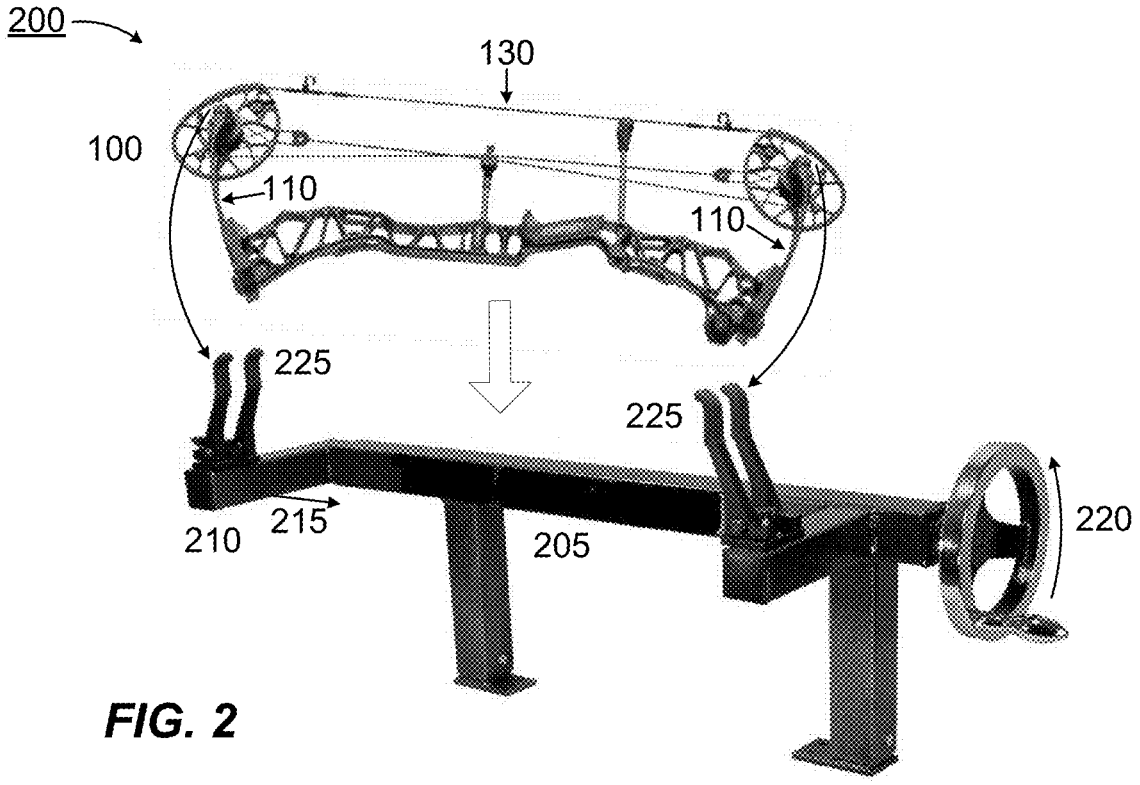
FIG. 2 shows the compound bow of FIG. 1 to be placed between, and retained by, brackets of a bow press, according to an embodiment.

FIG. 2 shows the compound bow of FIG. 1 to be placed between, and retained by, brackets of a bow press, according to an embodiment 200. In the embodiment of FIG. 2, compound bow 100 has been reoriented so as to fit securely between brackets 225 of bow press 205. Upon situating compound bow 100 to be at least proximate with brackets 225, length adjuster 220, which may comprise a hand cranked screw that operates to draw an adjustable arm in the direction of arrow 215, the bow may be tightly confined within brackets 225. Length adjuster 220 may then be further adjusted so as to compress compound bow 100 by a desired amount. Responsive to suitable compression of compound bow 100, resulting in drawing limbs 110 towards the center of compound bow 100, a technician may perform adjustments to the compound bow, replace one or more strings or other components of the compound bow, or the like. In particular embodiments, a bow press, such as the bow press of FIG. 2, may accommodate a bow having a limb-to-limb dimension of between approximately 63 cm (approximately 25.0 inches) to approximately 112 cm (approximately 44 inches). Accordingly, the bow press of FIG. 2 may be incapable of accommodating smaller compound bows and crossbows, such as those comprising limb-to-limb dimensions of, for example, approximately 30.5 cm (approximately 12 inches) or smaller.

Figure 3:
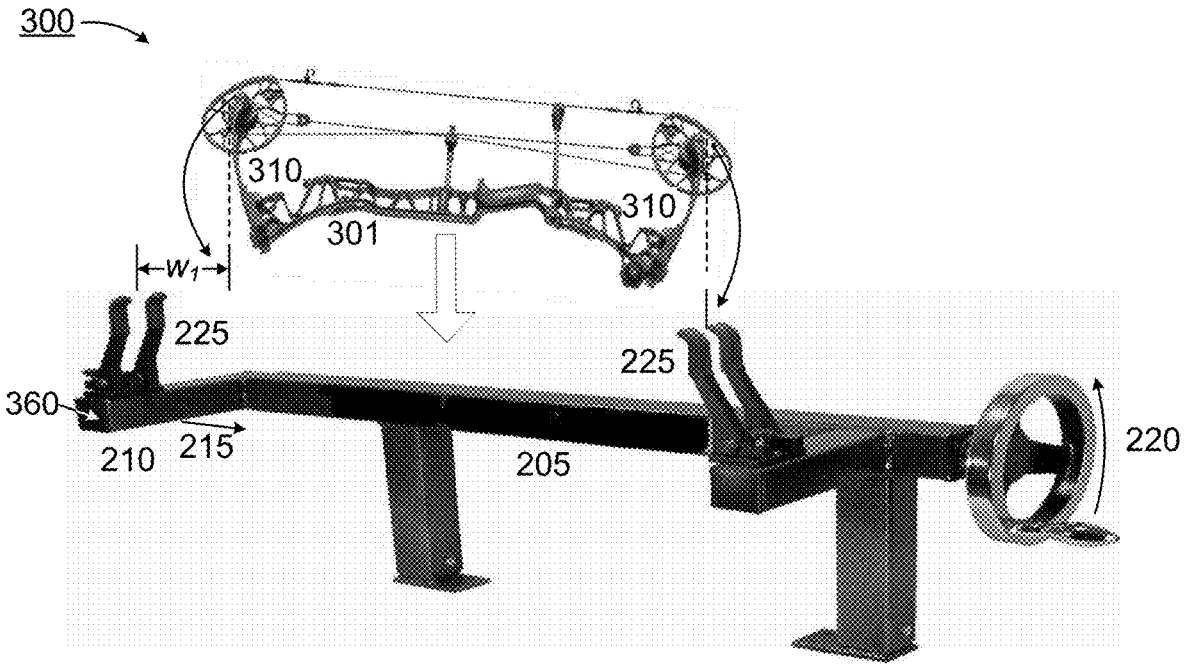
FIG. 3 shows a compound bow having a length that is less than the minimum length that can be accommodated by a bow press, according to an embodiment.

FIG. 3 shows a compound bow having a length that is less than the minimum length that can be accommodated by a bow press, according to an embodiment 300. In the embodiment of FIG. 3, compound bow 301 includes features similar to those of compound bow 100 (of FIGS. 1 and 2); however, compound bow 301 may comprise a smaller-sized version of compound bow 100. Thus, compound bow 301 may comprise a limb-to-limb dimension of approximately 30.5 cm (approximately 12 inches) to a dimension that is less than approximately 63 cm (approximately 25.0 inches). In the embodiment of FIG. 3, length adjuster 220 may draw adjustable arm 210 of bow press 205 in the direction shown by arrow 215. However, in the embodiment of FIG. 3, travel of adjustable arm 210, which may operate under the control of length adjuster 220, may be limited. Thus, as shown in FIG. 3, a technician may be capable of positioning a first limb 310 proximate with one of brackets 225, while a second limb remains at a distance given by $w_1$ with respect to a second one of brackets 225 proximate to opening 360. Thus, in such a scenario, a technician may be precluded from performing adjustments, modifications, etc., to compound bow 301.

Figure 4:
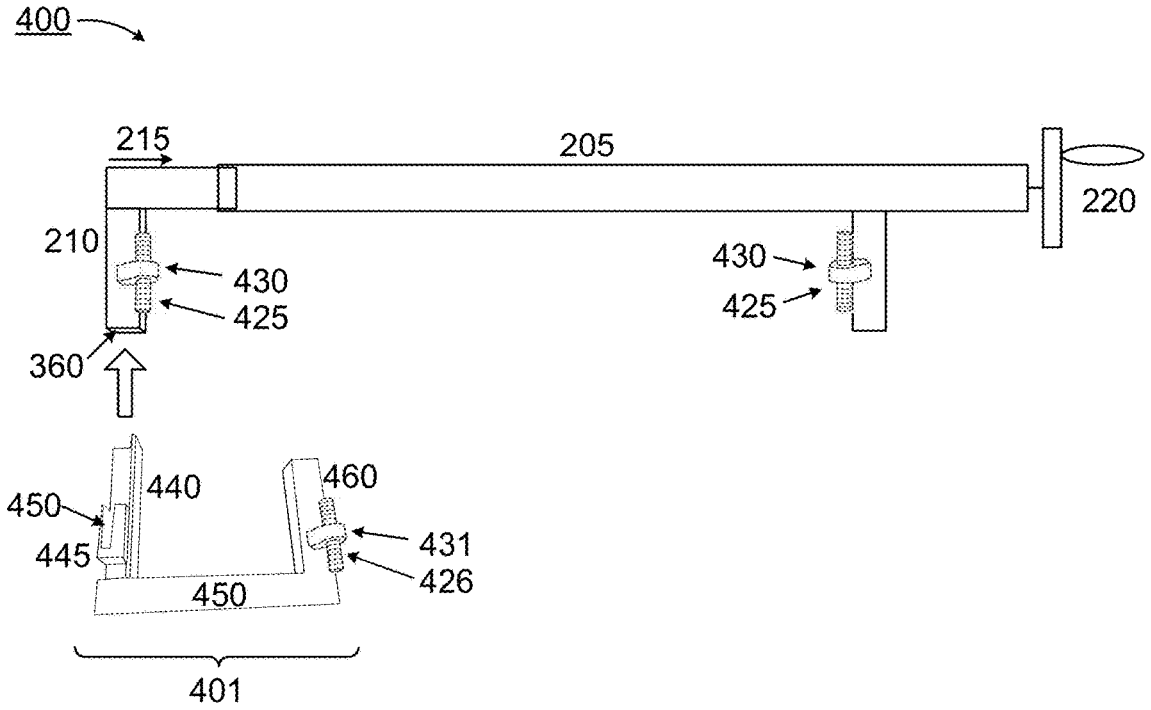
FIG. 4 is a top view of a bow press and an adapter assembly to be inserted into an opening of the bow press so as to accommodate the smaller-sized compound bow of FIG. 3, according to an embodiment.

FIG. 4 is a top view of a bow press and an adapter assembly, a portion of which is to be inserted into opening 360 of the bow press, according to an embodiment 400. As shown in FIG. 4, responsive to length adjuster 220 drawing adjustable arm 210 in the direction of length adjuster 220, the overall side-to-side length of bow press 205 may reach a minimum value. Accordingly, as described in relation to FIG. 3, bow press 205 may not accommodate a smaller-sized crossbow, a smaller-sized compound bow, etc. Thus, in particular embodiments, adapter assembly 401 may be utilized to accommodate the smaller-sized compound bow (e.g., compound bow 301 of FIG. 3). In the embodiment of FIG. 4, adapter assembly 401 may be formed from a metallic material, such as angle iron, steel tubing, and so forth. Thus, as shown, insert 440 of adapter assembly 401 may be fabricated so as to fit within opening 360 of bow press 205. Responsive to disposing or sliding insert 440 into opening 360, slot 447 of brace 445 may accommodate the reverse side of any type of fastener that operates to secure axle 425 and bushing 430 to adjustable arm 210. Thus, in the embodiment of FIG. 4, with insert 440 securely positioned within opening 360, brace 445 may come into contact with a plurality of surfaces (e.g., walls) that are internal to opening 360. It may be appreciated that in response to insert 440 being securely positioned within opening 360, arm 450, which is shown as abutting insert 440, extends in a direction away from arm 210, such as toward length adjuster 220. Accordingly, any bracket securable to axle 425 may be secured to axle 426 and secured against bushing 431, wherein axle 426 and bushing 431 are secured to mounting surface 460. Thus, it may be appreciated that utilizing adapter assembly 401, a smaller-sized compound bow, such as compound bow 301 of FIG. 3, may be retained between brackets affixed to axles 425 and 426.

Figure 5:
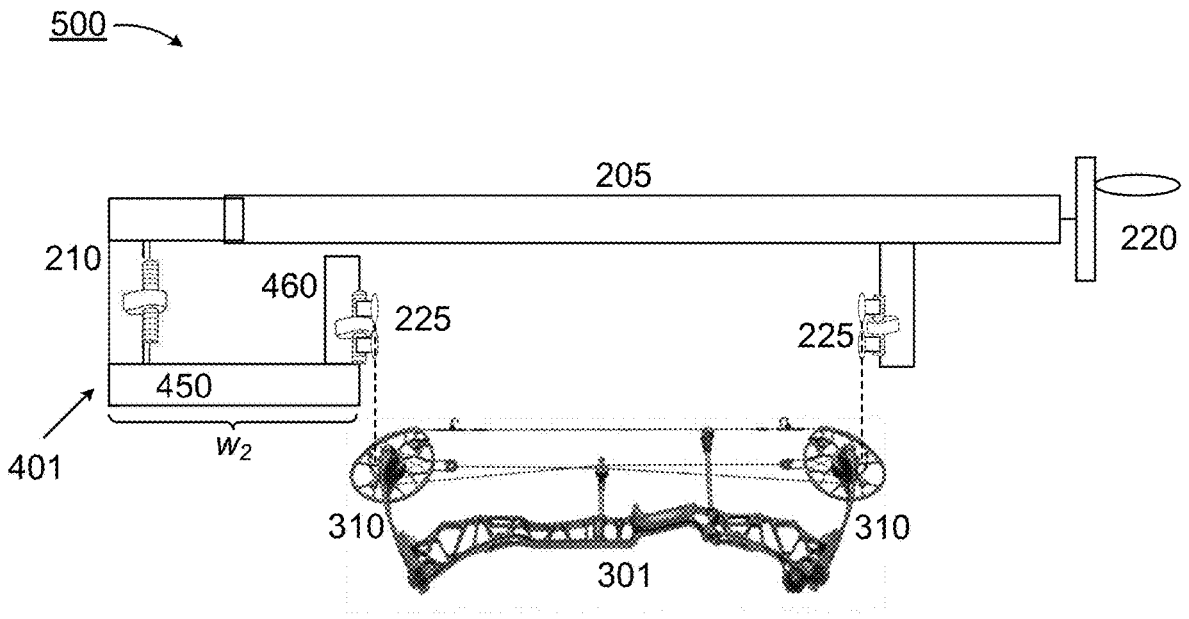
FIG. 5 is a top view of a bow press and an adapter assembly inserted into an opening of the bow press so as to accommodate the compound bow of FIG. 3, according to an embodiment.

FIG. 5 is a top view of a bow press and an adapter assembly inserted into an opening of the bow press so as to accommodate the compound bow of FIG. 3, according to an embodiment 500. As shown in FIG. 5, insert 440 (not shown in the FIG.) has been securely positioned within arm 210, which may comprise a hollow, tubular opening. Arm 450, which abuts insert 440, extends in a direction towards length adjuster 220. Mounting surface 460 is shown accommodating brackets 225 (by way of axle 425 and bushing 430, not shown in FIG. 5), which are utilized to securely retain smaller-sized compound bow. Thus, by way of actuating length adjuster 220, bow press 205, in cooperation with adapter assembly 401, may be capable of securing smaller-sized compound bow 301.

In the embodiment of FIG. 5, length $w_2$ is contemplated as comprising a value of between approximately 12.7 cm (approximately 5.0 inches) and approximately 38.1 cm (approximately 15.0 inches). It has been empirically determined that such a range of length ($w_2$) appears to accommodate a large number of smaller-sized compound bows, crossbows, and the like. In addition, it should be noted that it has been determined (such as empirically) that components of adapter assembly 401 may comprise a variety of metallic materials, such as iron and/or materials having a tensile strength of, for example, between approximately 20 kg and approximately 150 kg.

Figure 6:
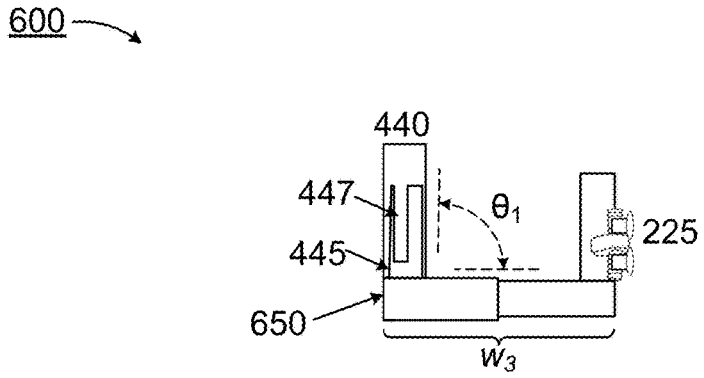
FIG. 6 is a top view of an adapter assembly having a linear adjustment and other features, according to an embodiment.

FIG. 6 is a top view of an adapter assembly, according to an embodiment 600. In the embodiment of FIG. 6, arm 650 is shown as being adjustable in length, thereby providing an additional approach toward accommodating a smaller-sized compound bow, a crossbow, or related equipment, in cooperation with bow press 205. In FIG. 6, a length of arm 650 ($w_3$) may be adjustable from between approximately 12.7 cm (approximately 5.0 inches) and approximately 25.4 cm (approximately 10.0 inches). In other embodiments, a length of arm 650 ($w_3$) may be adjustable from between approximately 10.2 cm (approximately 4.0 inches) and approximately 38.1 cm (approximately 15.0 inches), and claimed subject matter is not limited in this respect. In addition, also as indicated in FIG. 6, although an angle between insert 440 and adjustable arm 650 is shown as being at approximately 90° angles with respect to each other, such as between approximately 60° and approximately 120°, claimed subject matter is intended to embrace a variety of angles between insert 440 and arm 650. Further, although the components of adapter assemblies shown in the figures appear to be placed in the same (e.g., horizontal plane), nothing prevents certain components from being elevated, for example, with respect to other components, so as to accommodate various types of bow presses other than bow press 205.

Unless otherwise indicated, in the context of the present patent application, the term "or" if used to associate a list, such as A, B, or C, is intended to mean A, B, and C, here used in the inclusive sense, as well as A, B, or C, here used in the exclusive sense. With this understanding, "and" is used in the inclusive sense and intended to mean A, B, and C; whereas "and/or" can be used in an abundance of caution to make clear that all of the foregoing meanings are intended, although such usage is not required. In addition, the term "one or more" and/or similar terms is used to describe any feature, structure, characteristic, and/or the like in the singular, "and/or" is also used to describe a plurality and/or some other combination of features, structures, characteristics, and/or the like. Likewise, the term "based on" and/or similar terms are understood as not necessarily intending to convey an exhaustive list of factors, but to allow for existence of additional factors not necessarily expressly described.

Furthermore, it is intended, for a situation that relates to implementation of claimed subject matter and is subject to testing, measurement, and/or specification regarding degree, that the particular situation be understood in the following manner. As an example, in a given situation, assume a value of a physical property is to be measured. If alternatively reasonable approaches to testing, measurement, and/or specification regarding degree, at least with respect to the property, continuing with the example, is reasonably likely to occur to one of ordinary skill, at least for implementation purposes, claimed subject matter is intended to cover those alternatively reasonable approaches unless otherwise expressly indicated. As an example, if a plot of measurements over a region is produced and implementation of claimed subject matter refers to employing a measurement of slope over the region, but a variety of reasonable and alternative techniques to estimate the slope over that region exist, claimed subject matter is intended to cover those reasonable alternative techniques unless otherwise expressly indicated.

It is noted, nonetheless, that a typical measurement model employed is that one or more measurements may respectively comprise a sum of at least two components. Thus, for a given measurement, for example, one component may comprise a deterministic component, which in an ideal sense, may comprise a physical value (e.g., sought via one or more measurements), often in the form of one or more forces, signal samples and/or states, and one component may comprise a random component, which may have a variety of sources that may be challenging to quantify. At times, for example, lack of measurement precision may affect a given measurement. Thus, for claimed subject matter, a statistical or stochastic model may be used in addition to a deterministic model as an approach to identification and/or prediction regarding one or more measurement values that may relate to claimed subject matter.

For example, a relatively large number of measurements may be collected to better estimate a deterministic component. Likewise, if measurements vary, which may typically occur, it may be that some portion of a variance may be explained as a deterministic component, while some portion of a variance may be explained as a random component. Typically, it is desirable to have stochastic variance associated with measurements be relatively small, if feasible. That is, typically, it may be preferable to be able to account for a reasonable portion of measurement variation in a deterministic manner, rather than a stochastic matter as an aid to identification and/or predictability.

Along these lines, a variety of techniques have come into use so that one or more measurements may be processed to better estimate an underlying deterministic component, as well as to estimate potentially random components. These techniques, of course, may vary with details surrounding a given situation. Typically, however, more complex problems may involve use of more complex techniques. In this regard, as alluded to above, one or more measurements of physical manifestations may be modelled deterministically and/or stochastically. Employing a model permits collected measurements to potentially be identified and/or processed, and/or potentially permits estimation and/or prediction of an underlying deterministic component, for example, with respect to later measurements to be taken. A given estimate may not be a perfect estimate; however, in general, it is expected that on average one or more estimates may better reflect an underlying deterministic component, for example, if random components that may be included in one or more obtained measurements, are considered. Practically speaking, of course, it is desirable to be able to generate, such as through estimation approaches, a physically meaningful model of processes affecting measurements to be taken.

In the preceding description, various aspects of claimed subject matter have been described. For purposes of explanation, specifics, such as amounts, systems and/or configurations, as examples, were set forth. In other instances, well-known features were omitted and/or simplified so as not to obscure claimed subject matter. While certain features have been illustrated and/or described herein, many modifications, substitutions, changes and/or equivalents will now occur to those skilled in the art. It is, therefore, to be understood that the appended claims are intended to cover all modifications and/or changes as fall within claimed subject matter.

What is claimed is:

1. An adapter assembly for use with a bow press, the adapter assembly comprising:

an insert disposed at a first end portion of the bow press for inclusion within an opening of the bow press;

an arm that abuts the insert; and an axle and bushing for a first bracket, the first bracket to exert a compressive force on at least one limb of a bow while the bow is placed between the first bracket and a second bracket at a second end portion opposite the first end portion, the arm extending in a direction toward the second end portion.

2. The adapter assembly of claim 1, wherein the insert comprises an angled metallic material that is brought into contact with one or more internal surfaces of the opening of the bow press.

3. The adapter assembly of claim 2, wherein the insert further comprises a brace for inclusion with the insert into the opening of the bow press, the brace to be brought into contact with one or more additional internal surfaces of the opening of the bow press.

4. The adapter assembly of claim 3, wherein the brace comprises a slot to accommodate a fastener, the fastener to secure the axle and bushing the first bracket.

5. The adapter assembly of claim 1, wherein the arm abuts the insert at an angle of between approximately 60° and approximately 120°.

6. The adapter assembly of claim 1, wherein the arm abuts the insert at an angle of approximately 90.0°.

7. The adapter assembly of claim 1, wherein the arm comprises an adjustable length, the adjustable length being between approximately 12.7 cm (approximately 5.0 inches) and approximately 38.1 cm (approximately 15.0 inches).

8. The adapter assembly of claim 1, wherein the arm comprises a material having a tensile strength of between approximately 20 kg and approximately 150 kg.

9. A bow press to exert a compressive force on at least one limb of a bow, comprising:

a body of the bow press comprising a bow press length adjuster;

a first axle and a first bushing and a second axle and a second bushing, the first axle and the first bushing to accept a first bracket and the second axle and the second bushing to accept a second bracket, the first bracket and the second bracket cooperating to retain the bow responsive to adjustment of the bow press length adjuster; and an adapter assembly, the adapter assembly having an insert included within an opening of the bow press proximate the second bracket, the adapter assembly having at least one additional axle and one additional bushing to accept at least one additional bracket, the adapter assembly having an arm that operates to reduce a linear dimension between the at least one additional bracket and the first bracket relative to a linear dimension between the first bracket and the second bracket.

10. The bow press of claim 9, wherein the insert of the adapter assembly comprises an angled metallic material that is brought into contact with one or more internal surfaces of the opening of the bow press.

11. The bow press of claim 10, wherein the insert of the adapter assembly further comprises a brace for inclusion with the insert into the opening of the bow press, the brace to be brought into contact with one or more additional internal surfaces of the opening of the bow press.

12. The bow press of claim 11, wherein the brace of the insert comprises a slot to accommodate a reverse side of a fastener, the fastener to secure the second axle in the second bushing for the second bracket.

13. The bow press of claim 9, wherein the arm of the adapter assembly abuts the insert at an angle of between approximately 60° and approximately 120°.

14. The bow press of claim 13, wherein the arm of the adapter assembly abuts the insert at an angle of approximately 90.0°.

15. The bow press of claim 9, wherein the arm of the adapter assembly comprises an adjustable length, the adjustable length being between approximately 12.7 cm (approximately 5.0 inches) and approximately 38.1 cm (approximately 15.0 inches).

16. The bow press of claim 9, wherein the arm of the adapter assembly comprises a material having a tensile strength of between approximately 20 kg and approximately 150 kg.

17. The bow press of claim 9, wherein the arm of the adapter assembly and the body of the bow press operate in substantially the same plane.

18. An adapter assembly for use with a bow press, the adapter assembly comprising:

an insert for inclusion within a tubular opening of the bow press;

an arm that abuts the insert; and a mounting surface that abuts the arm, the mounting surface to accommodate a first axle and first bushing for a first bracket, the first bracket, the mounting surface, the arm, and the insert being to exert a compressive force on at least one limb of a bow responsive to positioning of the bow between the first bracket of the bow press and a second bracket of the bow press.

19. The adapter assembly of claim 18, wherein the insert comprises a slotted bracket coupled to the insert for inclusion within the tubular opening of the bow press.

20. The adapter assembly of claim 19, wherein the adapter assembly comprises a material having a tensile strength of between approximately 20 kg and approximately 150 kg.

* * * * *